US008842870B2

(12) United States Patent
East et al.

(10) Patent No.: US 8,842,870 B2
(45) Date of Patent: Sep. 23, 2014

(54) AUDIO APPARATUS

(75) Inventors: James East, Kowloon Tong (HK); Neil Simon Owen, Huntingdon (GB)

(73) Assignee: NVF Tech Ltd., Cambridgeshire (GB)

( * ) Notice: Subject to any disclaimer, the term of this patent is extended or adjusted under 35 U.S.C. 154(b) by 1245 days.

(21) Appl. No.: 12/451,695

(22) PCT Filed: Apr. 17, 2008

(86) PCT No.: PCT/GB2008/001346
§ 371 (c)(1),
(2), (4) Date: Jun. 1, 2012

(87) PCT Pub. No.: WO2008/145949
PCT Pub. Date: Dec. 4, 2008

(65) Prior Publication Data

US 2012/0237075 A1 Sep. 20, 2012

(30) Foreign Application Priority Data

May 31, 2007 (GB) ..... 0710378.1

(51) Int. Cl.

| | |
|---|---|
| ***H04R 25/00*** | (2006.01) |
| ***H04R 1/10*** | (2006.01) |
| *H04R 17/00* | (2006.01) |
| *H04R 5/033* | (2006.01) |

(52) U.S. Cl.
CPC ..... *H04R 1/1066* (2013.01); *H04R 17/00* (2013.01); *H04R 5/0335* (2013.01)
USPC ..... 381/381; 381/173; 381/190

(58) Field of Classification Search
USPC ..... 381/381, 374, 326, 327, 330, 376, 383, 381/387, 190, 191, 173, 385, 386, 392; 181/129
See application file for complete search history.

(56) References Cited

U.S. PATENT DOCUMENTS

| | | | | |
|---|---|---|---|---|
| 2,528,811 | A * | 11/1950 | Balbi | 381/380 |
| 4,990,816 | A * | 2/1991 | Causse et al. | 310/324 |
| 2002/0039427 | A1 * | 4/2002 | Whitwell et al. | 381/312 |
| 2003/0048915 | A1 | 3/2003 | Bank | |
| 2005/0129257 | A1 * | 6/2005 | Tamura | 381/151 |
| 2005/0168111 | A1 | 8/2005 | Bank et al. | |

FOREIGN PATENT DOCUMENTS

| | | |
|---|---|---|
| EP | 0 385 888 A1 | 9/1990 |
| EP | 1 542 499 A2 | 6/2005 |
| JP | 56089200 | 7/1981 |
| JP | 61 208399 A | 9/1986 |

(Continued)

OTHER PUBLICATIONS

PCT International Preliminary Report on Patentability, Int'l. application No. PCT/GB2008/001346, filed Apr. 17, 2008, 9 pages, WIPO, Geneva, Switzerland.

(Continued)

*Primary Examiner* — Curtis Kuntz
*Assistant Examiner* — Sunita Joshi
(74) *Attorney, Agent, or Firm* — Gable Gotwals

(57) ABSTRACT

Audio apparatus comprising a housing and a piezoelectric transducer (12) mounted in the housing (10) so that the transducer is adjacent a user's pinna whereby the transducer excites vibration in the pinna to cause it to transmit an acoustic signal from the transducer to a user's inner ear characterised by comprising a coupler (14) coupling the transducer (12) to the housing (10) with the coupler (14) approximating to a simple support for the transducer (12).

12 Claims, 7 Drawing Sheets

(56) References Cited

FOREIGN PATENT DOCUMENTS

| | | | |
|---|---|---|---|
| JP | 2005-328125 | A | 11/2005 |
| JP | 2006005625 | A | 1/2006 |
| WO | WO 97/09861 | A1 | 3/1997 |
| WO | WO 99/50706 | A1 | 10/1999 |
| WO | WO 01/87007 | A1 | 11/2001 |
| WO | WO 02/30151 | A2 | 4/2002 |
| WO | WO 2005/025267 | A1 | 3/2005 |

OTHER PUBLICATIONS

The First Office Action (PCT application entering Chinese national phase), Chinese Patent Application No. 200880101063.9, Issuing Date: Jun. 15, 2011, 8 pages, SIPO, China.

* cited by examiner

AUDIO APPARATUS

TECHNICAL FIELD

The invention relates to audio apparatus and more particularly to audio apparatus for personal use.

BACKGROUND ART

It is known to provide earphones which may be inserted into a user's ear cavity or headphones comprising a small loudspeaker mounted on a headband and arranged to be placed against or over the user's ear. Such sound sources transmit sound to a user's inner ear via the ear drum using air pressure waves passing along the ear canal.

A typical conventional earphone uses a moving coil type transducer mounted in a plastic housing. The moving coil is connected to a light diaphragm which is designed to fit into the entrance of the ear canal. The moving coil and diaphragm are light and are coupled intimately to the eardrum at the other end of the ear canal. The acoustic impedance of the eardrum and ear canal seen by the moving coil transducer is relatively small. This small impedance in conjunction with the intimate coupling means that the motion requirements of the moving coil transducer are relatively low.

A moving coil transducer requires a magnetic circuit, which typically contain metal parts, e.g. steel or iron pole pieces, to generate magnetic field lines for the coil to move. These parts provide a relatively large inertial mass which combined with the low motion requirement means that relatively little vibration enters the housing.

There are disadvantages associated with both headphones and earphones. For example, they may obstruct normal auditory process such as conversation or may prevent a user from hearing useful or important external audio information, e.g. a warning. Furthermore, they are generally uncomfortable and if the volume of the sound being transmitted is too high they may cause auditory overload and damage. Earpieces which fit into the ear canal also have hygiene issues.

An alternative method of supplying sound to a user's inner ear is to use bone conduction as for example in some types of hearing aids. In this case, a transducer is fixed to a user's mastoid bone to be mechanically coupled to the user's skull. Sound is then transmitted from the transducer through the skull and directly to the cochlea or inner ear. The eardrum is not involved in this sound transmission route. Locating the transducer behind the ear provides good mechanical coupling. Nevertheless, quite high power and applied force is generally necessary for good results.

One disadvantage is that the mechanical impedance of the skull at the location of the transducer is a complex function of frequency. Furthermore, the apparatus needs to be a favourable fit on the skill. Thus, the design of the transducer and the necessary electrical equalisation may be expensive and difficult.

Alternative solutions are proposed in JP56-089200 (Matsushita Electric Ind Co Ltd), WO 01/87007 (Temco Japan Co, Ltd) and WO 02/30151 and WO 05-025267 to the present applicant. In each publication, a transducer is coupled direct to a user's pinna, in particular behind a user's earlobe, to excite vibration therein whereby an acoustic signal is transmitted to the user's inner ear.

WO 02/30151 and WO 05-025267 describe various ways of attaching a transducer to a user's pinna, including specially designed hooks and clips.

DISCLOSURE OF INVENTION

According to a first aspect of the invention, there is provided audio apparatus comprising a housing and a piezoelectric transducer mounted in the housing so that the transducer is adjacent a user's pinna whereby the transducer excites vibration in the pinna to cause it to transmit an acoustic signal from the transducer is to a user's inner ear characterised by comprising a coupler which simply supports the transducer on the housing.

A piezoelectric transducer may have three distinguishable boundary conditions, namely free, clamped (or fixed) and simply supported (or pinned). The behaviour of the beam is quite different for each condition.

Fixing to a stub or coupler constitutes a clamp at that location where all movement is restrained, both for deflection (displacement) and for rotation. The free case allows both kinds of movement.

For the simply supported case displacement in any axis is prevented but rotation is allowed. A "simple support" is thus to be understood as a technical term in acoustical engineering to define the boundary condition of a resonant plate or beam of a piezoelectric transducer. The plate of the transducer is supported to permit pivotal movement about the support but to prevent translational movement relative to the support. A simple support is thus distinguished from other boundary conditions where the plate is clamped at its edge or where the plate is free at its edge.

The transducer may be a distributed mode transducer (e.g. of the type taught in WO01/54450). Simply supporting the ends of a distributed mode beam transducer would be expected to stiffen the beam, hence raising its fundamental frequency. A man skilled in the art would expect a decrease in low frequency performance as a result of the raising of the fundamental frequency. However, somewhat surprisingly, simply supporting the ends of the beam transducer greatly improves the low performance but with a general reduction in the power delivered in the mid and high frequency range. Simply supporting the transducer on the housing, also means that the audio apparatus is more robust to impacts.

A piezoelectric transducer is generally of low weight, small size and high efficiency. The transducer may be a beam type device with two beams laminated with piezoelectric ceramics. Such material is shape-changing and produces bending resonances within the beams of the transducer to generate a modal exciting force. The two beams may be separated by a central vane which may extend beyond the ends of the ceramic beams.

The material parameters (e.g. density, loss, resilience, damping and shear) of the coupler are preferably selected to provide a simple support, i.e. to allow rotational but not translational movement. The coupler may have a reasonably low shear modulus to allow rotation but a high bulk modulus to resist translation. Some damping may also be useful.

The blocks may be made from an elastomer or rubber whereby rotation is allowed due to shear despite the high compressive stiffness of the material. The coupler may be made from an elastomer such as unsaturated rubber that can be cured by sulphur vulcanization, e.g. natural rubber (NR), polyisoprene (IR), butyl rubber (copolymer of isobutylene and isoprene, IIR), halogenated butyl rubbers (Chloro Butyl Rubber: CIIR; Bromo Butyl Rubber: BIIR), polybutadiene (BR), styrene-butadiene rubber (copolymer of polystyrene and polybutadiene, SBR), nitrile Rubber (copolymer of polybutadiene and acrylonitrile, NBR), also called buna N rubbers, hydrated Nitrile Rubbers (HNBR) Therban® and Zetpol®, chloroprene Rubber (CR), polychloroprene, Neoprene, Baypren etc. Alternatively, the elastomer may be a saturated rubber that cannot be cured by sulphur vulcanization, e.g. EPM (ethylene propylene rubber, a copolymer faeces of polyethylene and polypropylene) and EPDM rubber (ethylene propylene diene rubber, a terpolymer of polyethylene, polypropylene and a diene-component), epichlorohydrin rubber (ECO), polyacrylic rubber (ACM, ABR), silicone rubber (SI, Q, VMQ), fluorosilicone rubber (FVMQ), fluoroelastomers (FKM, FPM) Viton®, Tecnoflon®, Fluorel® and Dai-El®, perfluoroelastomers (FFKM) Kalrez®, Polyether Block Amides (PEBA), tetrafluoro ethylene/propylene rubbers (FEPM), chlorosulfonated Polyethylene (CSM), (Hypalon®) and ethylene-vinyl acetate (EVA). Other suitable elastomers include thermoplastic elastomers (TPE), for example Hytrel®, thermoplastic vulcanizates (TPV), for example Santoprene® TPV, polyurethane rubber, resilin, elastin and polysulfide rubber.

The elastomer may be a polymer or cellular foam, e.g. foam sold under the trademark Poron®. Such elasto-meric foams are flexible, high density, microcellular products which maintain excellent resistance to compression set (collapse), exhibit high resiliency, good vibration damping and impact absorption.

The material may be selected to have a translation stiffness kz and/or rotational stiffness kr which provide an approximate simple support. Ranges of suitable stiffnesses may be derived from consideration of the appropriate equations.

For example, for a transducer in the form of a piezoelectric beam with a support and a rotary spring (kr) at one end and a normal spring (kz) at the other, the lowest mode of a beam varies with the values of translation and rotational stiffness. kz=0 is free, kz=infinity is supported and kr=0 is supported and kr=infinity is clamped. An approximation to a simple support may be achieved by selecting the maximum kr to be midway between 0 and infinity and the minimum kz to be midway between 0 and infinity.

This gives:

$$kz > \text{about } 3EI/L^3$$

$$kr < \text{about } 3EI/L$$

where

E=Young's modulus

I=Area moment of inertia ($\frac{1}{12}\times$thickness$^3\times$width).

L=length

The shear modulus G is given by $$G=E/2/(1+nu)\sim\tfrac{3}{8}\times E$$

For a transducer having a piezoelectric beam which is 1 mm thick, 25 mm long and has a Young's modulus of approximately 64 Gpa, kz sets the shear modulus to have a minimum value of 220 kPa and kr sets the shear modulus to have a maximum value of 32 MPa. Accordingly, the Young's modulus preferably lies between 500 kPa and 83 MPa and the shear modulus between 200 kPa and 32 MPa.

The transducer may be rectangular and the coupler may comprise portions engaging opposite edges of the transducer. The transducer may be generally disc-shaped and the coupler may extend along part or whole of the transducer. Alternatively, the coupler may be located at least three positions on the perimeter and the positions may be equally spaced around the perimeter. The transducer may be triangular and the coupler may be located at each vertex of the triangle. The transducer may be trapezoidal or hyperelliptical. The transducer may be plate-like and may be planar or curved out of planar.

The housing may comprise a resilient layer which forms the interface between the transducer and a user's pinna. The resilient layer may be made of a softer non porous material such as silicone elastomer. The resilient layer may have a porous, foam like core, e.g. vinyl or nitrile or other synthetic rubbers, to provide resilience. The purpose of the resilient layer is to provide a hygienic, non allergenic cushioned contact area to the region of the pinna being driven.

The mechanical properties, in particular mechanical impedance and/or modal properties where appropriate, of the transducer and/or resilient layer may be selected to match those of a typical pinna. Alternatively, the mechanical properties may be selected for suitability to the application. For example, if the matched transducer is too thin to be durable, the mechanical impedance of the transducer may be increased to provide greater durability.

The mechanical properties of the transducer and/or resilient layer may be matched to optimise the contact force between the transducer and the pinna and/or to optimise the frequency range of the transducer. The mechanical properties of the transducer may include the location of the mounting, added masses, the number of piezoelectric layers. The transducer may have an off centre mounting whereby a torsional force is used to provide good contact to the pinna. Masses may be added, for example at the ends of the piezoelectric element, to improve the low frequency bandwidth. The transducer may have multiple layers of piezoelectric material whereby the voltage sensitivity may be increased and the voltage requirement of an amplifier may be reduced. The or each layer of piezoelectric material may be compressed.

Electrical connections to a piezoelectric transducer are generally problematic. For example, fragile wires are commonly soldered to the piezoelectric beams. According to another aspect of the invention, the coupler may be made from a conductive material whereby a more robust electrical connection between the transducer and a sound source may be achieved. For a piezoelectric transducer comprising a central vane sandwiched between two piezoelectric elements, the central vane may extend beyond the ends of the piezoelectric elements and the conductive coupler may be coupled to the central vane. Such an electrical connection obviates the need to provide very low resistance connections for high impedance piezoelectric transducers.

The transducer housing may be attachable to eyewear. Eyewear includes all forms of goggles, spectacles, glasses and sunglasses. The pinna is the whole of a user's outer ear. The transducer may be coupled to a rear face of a user's pinna adjacent to a user's concha.

The housing may attach to an arm of the pair of spectacles or the band of a pair of goggles, e.g. via a spring loaded clip, or an eyelet type fastener. The housing may be in the form of an elastic sleeve which slides over the arm. Alternatively, the housing may be in the form of an arm or part of an arm of a pair of spectacles which is exchangeable with an arm or part of an arm of a user's conventional spectacles, e.g. via screw or clip mechanisms.

In this way, regular sunglasses, goggles or spectacles may be adapted to operate as a headset. Such audio apparatus is comfortable and convenient to wear. Nothing is placed in the ear so there are no hygiene issues. Furthermore, the apparatus may be hidden behind the ear and is thus discreet.

The audio apparatus may comprise a built-in facility to locate the optimum location of the transducer on the spectacles for each individual user in a similar manner to that taught in WO 02/30151. The audio apparatus may comprise an equaliser for applying an equalisation to improve the acoustic performance of the audio apparatus.

The audio apparatus may be unhanded, i.e. for use on both ears. A user may use two audio apparatuses, one mounted on each arm. The signal input may be different to each audio apparatus, e.g. to create a correlated stereo image to provide background music or may be the same for both audio apparatuses.

The audio apparatus may comprise a miniature built in microphone e.g. for a hands free telephony. In use, the microphone may be located near to the user's mouth for good two way communication. The audio apparatus may comprise a built in micro receiver, for example, for a wireless link to a local source e.g. a CD player or a telephone, located conveniently in a user's pocket or clipped to a jacket lapel, or to a remote source for broadcast transmissions. Alternatively, the audio apparatus may comprise a wired link to a local source.

The audio apparatus may incorporate an integrated amplifier, voltage converter, and/or power source. Electronics, e.g. Bluetooth electronics, may also be incorporated. Alternatively, these elements may be incorporated in an arm of a pair of spectacles to which the apparatus is to be attached.

The transducer may be wholly or partially enclosed by a housing. The housing may be made from a relatively soft material for example rubber, silicone or polyurethane. Alternatively, the housing may be of a rigid material, e.g. a metal (e.g. aluminium or steel), hard plastics (e.g. perspex, Acrylonitrile Butadiene Styrene (ABS) or a glass reinforced plastics so as to provide extra protection for the transducer, particularly during handling.

The housing material may also be non-conducting, non-allergenic and/or water resistant or waterproof. The apparatus preferably maintains performance when wet, i.e. by use of a waterproof housing which wholly encloses the transducer. The material preferably has minimal effect on the performance of the transducer, i.e. does not constrain movement of the transducer. The housing may provide some protection, e.g. from small shocks and the environment, particularly moisture. In this way, the apparatus may be mechanically stable and may be particularly suitable in sports and leisure applications, e.g. refereeing a sporting event, where a user is required to run. The housing may be moulded, cast or stamped.

The main advantage of the device is the ability to allow a user to listen to voice or music in the background whilst hearing their surroundings through an unobstructed ear canal. Accordingly, the audio apparatus may be used in all applications where natural and unimpeded hearing must be retained, e.g. enhanced safety for pedestrians and cyclists who are also listening to programme material via personal headphones. The sensation is analogous to a crowded room when it is possible to switch listening to different conversations and reduce other noises to a background level.

There are other beneficial psycho-acoustic effects, for example, the ability to hear a "side tone" of the user's own voice. This is a feedback for adjusting the volume level of speech. When using conventional headsets, listening quickly becomes uncomfortable as there is no side tone. Users of apparatus according the invention would be able to continue with a conversation much longer, without discomfort. Modern mobile phones do not have this side tone, which is one reason why people tend to shout into the handsets.

The audio apparatus described above may be used in many headset applications when the user demands a higher level of comfort, convenience, safety and security. A non-exhaustive list of applications includes hands free mobile phones, virtual conferencing, entertainment systems such as in-flight and computer games, communication systems for emergency and security services, underwater operations, active noise cancelling earphones, tinnitus maskers, call centre and secretarial applications, home theatre and cinema, enhanced and shared reality including data and information interfaces, training applications, museums, stately homes (guided tours) and theme parks and in-car entertainment. The audio apparatus may be used to augment the part of the frequency range for which a partially deaf person has poor hearing without impeding the deaf person's hearing over the rest of the frequency range.

The most widely used application for this type of headset is as a hands free device to be used with a mobile phone. The present apparatus is particularly suitable for this application as the speech quality is very good and it offers a lightweight design. Another speech application is for voice instructions from a personal navigation device. The user can discreetly hear directions, while being totally aware of their surroundings.

According to another aspect of the invention, there is provided eyewear incorporating audio apparatus as described.

BRIEF DESCRIPTION OF THE DRAWINGS

For a better understanding of the invention, and purely by way of example, specific embodiments of the invention will now be described, with reference to the accompanying drawings in which.

DETAILED DESCRIPTION OF THE DRAWINGS

Figure 1:
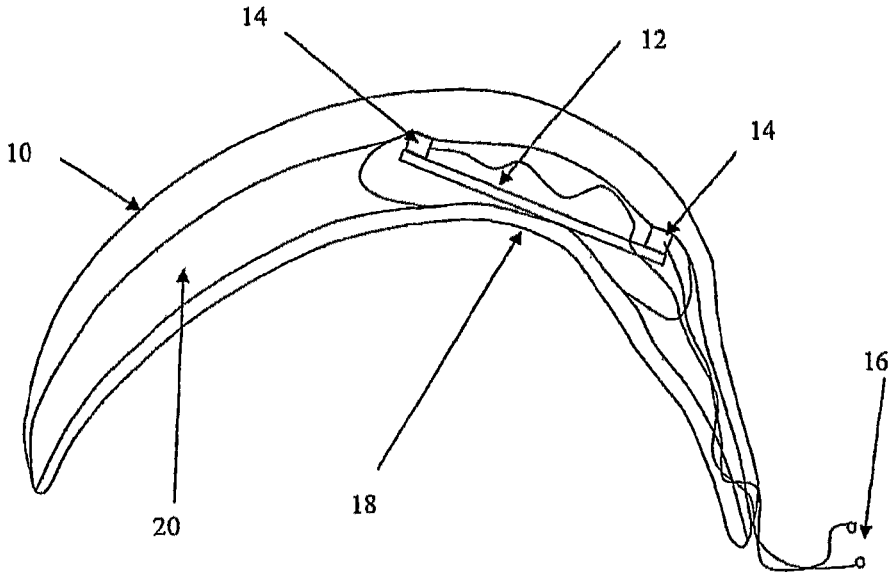
FIG. 1 is cross-sectional view of audio apparatus according to the invention.

FIG. 1 shows audio apparatus comprising a transducer 12 in the form of a piezoelectric beam transducer wholly enclosed within a housing. The housing comprises an outer rigid casing 10 and a resilient layer 18 which is the interface between a user's pinna and the transducer. A fill layer 20 defines a void between the outer casing 10 and the resilient layer 18 and the transducer is located in this void.

The transducer is a distributed mode actuator in accordance with the teaching of WO01/54450. The transducer 12 is simply supported on the housing 10 by two electrically conductive polymer foam blocks 14, one at each end of the transducer 12. Electrical connections 16 connecting the transducer 12 to a drive source are attached to the foam blocks 14. A drive signal is provided via the electrical connections to cause the transducer 12 to generate a force. This force is taken from a location off-set from the centre of the transducer and transmitted to a user's pinna via the resilient layer 18.

The resilient layer 18 is preferably a polymer moulding. The mechanical impedance and/or other properties of the resilient layer are selected to ensure a good interface between pinna and transducer.

Figure 2A:
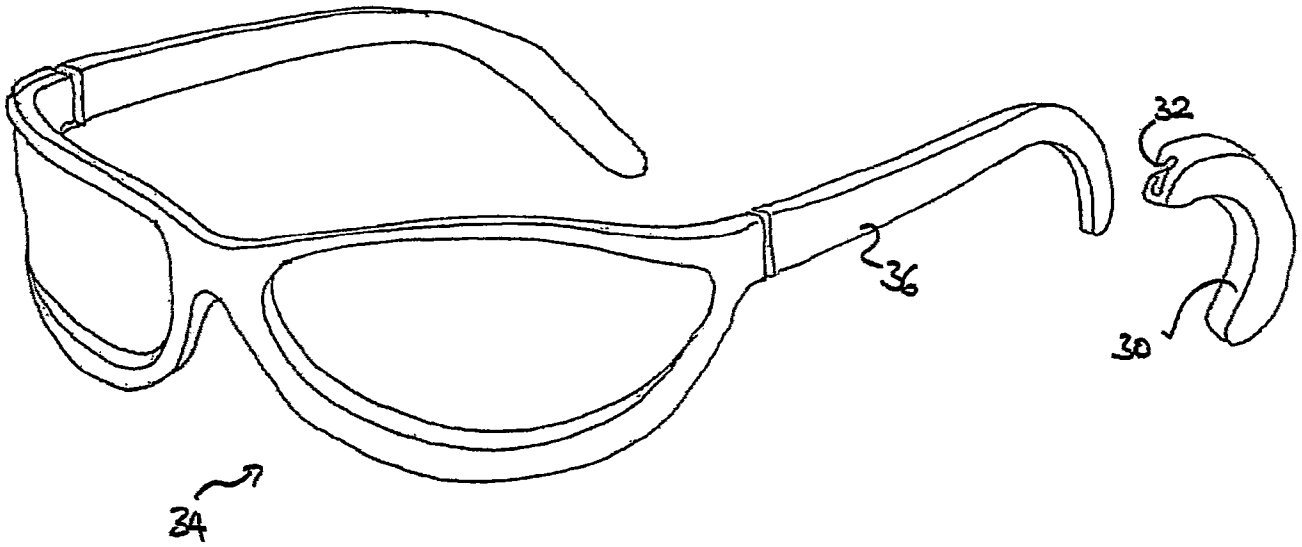
FIGS. 2*a* and 2*b* are each perspective views of a pair of spectacles incorporating audio apparatus according to the invention.
Figure 2B:
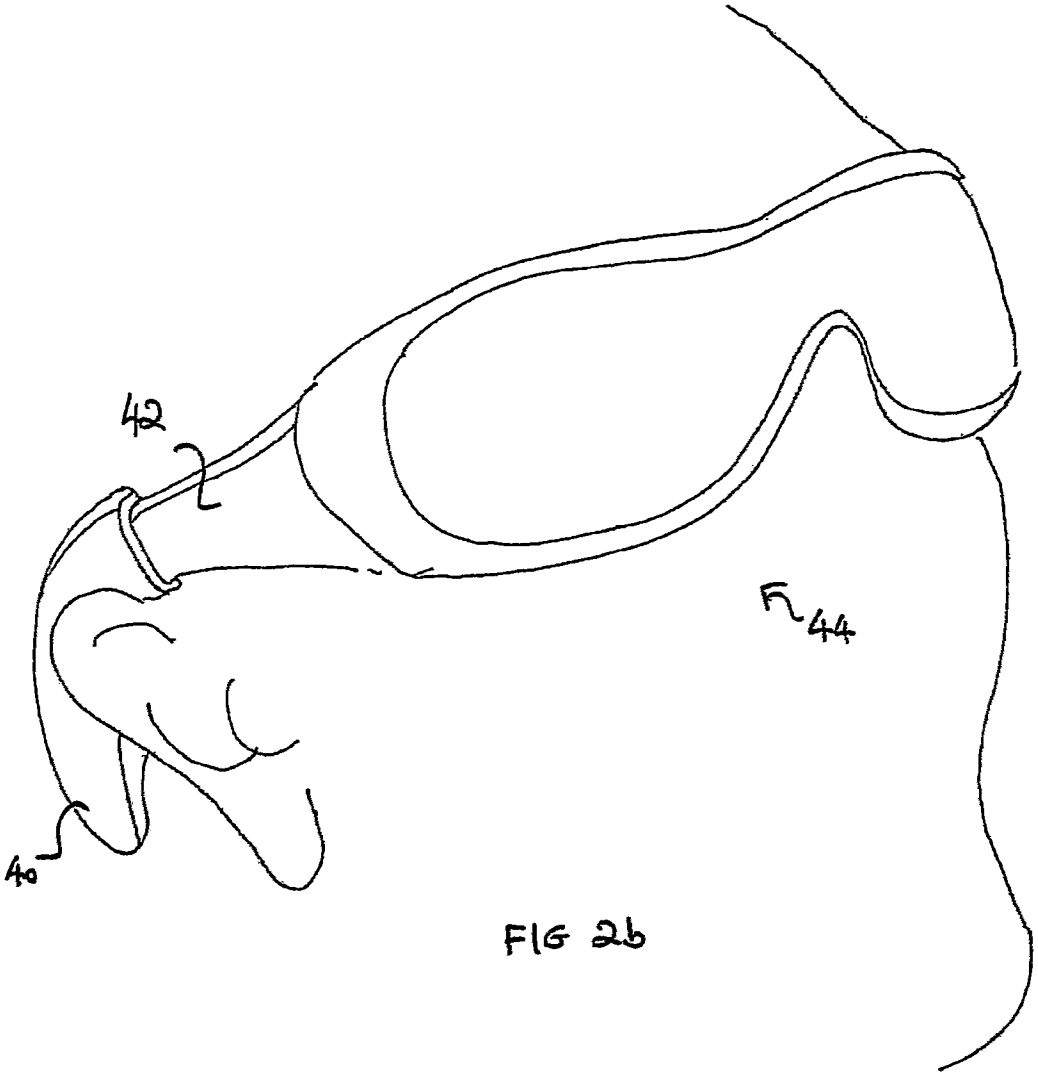
Figure 2C:
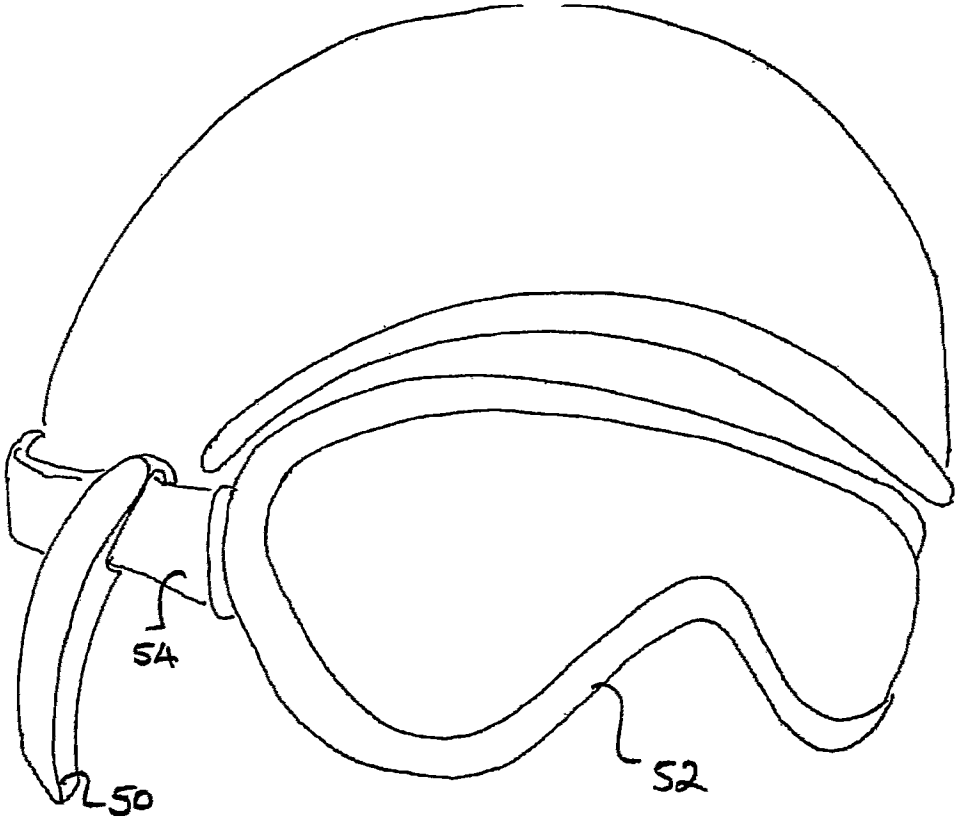
FIG. 2*c* is a perspective view of a pair of military goggles incorporating audio apparatus according to the invention.

FIGS. 2*a* to 2*c* show the audio apparatus of FIG. 1 attached to a pair of spectacles or a pair of goggles. In each embodiment, when a user is wearing the spectacles, the transducer is adjacent the rear face of a user's pinna. The transducer excites vibration, via the housing 10, in the pinna to cause it to transmit an acoustic signal to a user's inner ear.

In FIG. 2*a*, the audio apparatus housing 30 comprises a clip 32 which attaches to the arm 36 of a pair of spectacles 34. In FIG. 2*b*, the audio apparatus housing 40 is in the form of an elastic sleeve with a channel which is configured to receive an arm 42 of a pair of spectacles 44 (e.g. sunglasses or ordinary glasses). The apparatus is attached to a pair of spectacles 42 by sliding the channel over the arm 44. In FIG. 2*c*, the audio apparatus housing 50 comprises a channel which is configured to receive the head band 54 of the goggles 52. The apparatus is attached to the goggles by sliding the channel along the headband 54. The audio apparatus may also be part of a helmet 56.

Figure 3A:
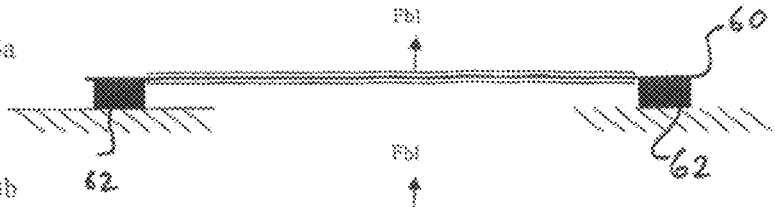
FIGS. 3*a* to 3*d* show alternative mounting conditions for the transducer of the audio apparatus of FIG. 1.
Figure 3B:
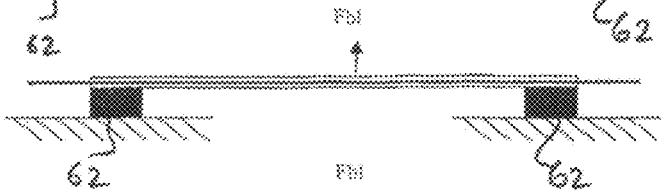
Figure 3C:
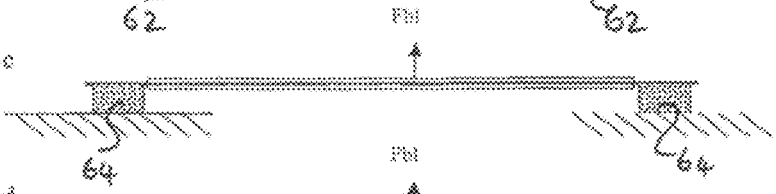
Figure 3D:
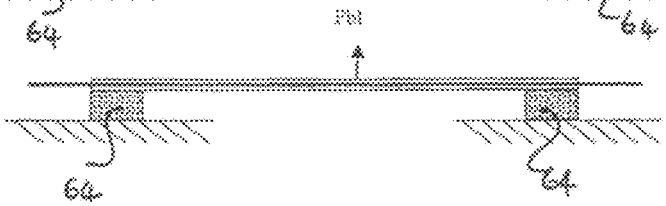

FIGS. 3*a* to 3*d* show four different couplers which may be used to couple the piezoelectric transducer to the housing of FIG. 1. In each Figure, the transducer comprises two piezoelectric ceramic beams and a central vane 60 which is sandwiched between and extends beyond the length of the two beams. In FIGS. 3*a* and 3*b*, the ends of the piezoelectric transducer are clamped by fixing to rigid foamed plastics blocks 62 made from Acrylonitrile Butadiene Styrene(ABS). In FIG. 3*a*, the blocks 62 are coupled to the portions of the central vane 60 which extend beyond the piezoelectric beams and in FIG. 3*b*, the blocks 62 are coupled to the lower beam. In FIGS. 3*c* and 3*d*, the ends of the piezoelectric transducer are coupled to foam blocks 64 which form a simple support. The blocks 64 are made from Poron® foamed plastic. In FIG. 3*c*, the foam blocks are coupled to the portions of the central vane 60 which extend beyond the piezoelectric beams and in FIG. 3*d*, the blocks 64 are coupled to the lower ceramic beam. The dimensions of all blocks are 2×2×3 mm.

Figure 3E:
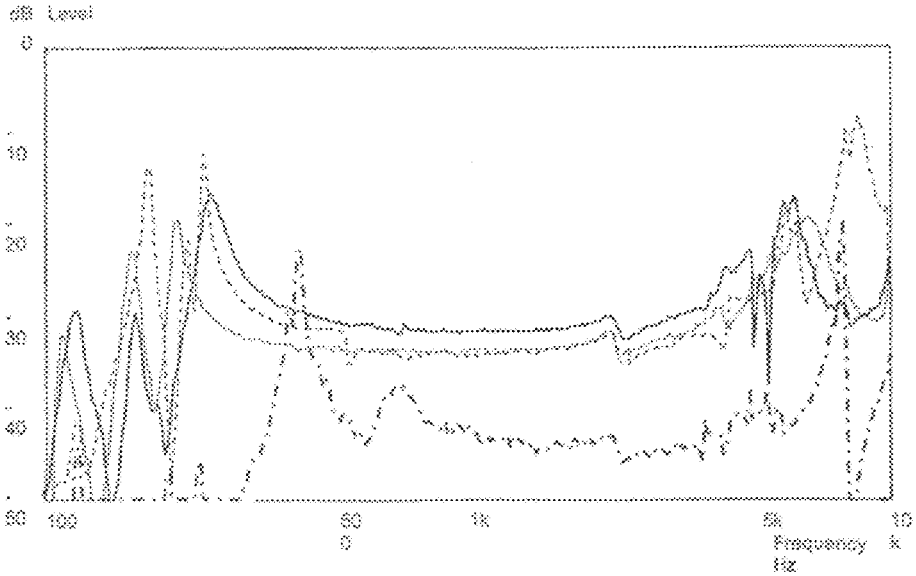
FIG. 3*e* is a graph of force against frequency for the mounting conditions of FIGS. 3*a* to 3*d;*

The table below shows the fundamental frequency $f_0$ and blocked force Fb1 taken from the offset central location. The simply supported embodiments have the lowest fundamental frequency with the mounting condition of FIG. 3*d* providing the most power. Clamping direct to the lower beam provides the worst performance. The performances are also compared in FIG. 3*e*, in which the chain dashed line shows the embodiment of FIG. 3*a*, the dashed line shows that of FIG. 3*b*, the dotted line that of FIG. 3*d* and the solid line that of FIG. 3*c*. The mounting condition of FIG. 3*d* is the most desirable.

| | fo (Hz) | $F_{bl}$ ($mN \cdot V^{-1}$) |
|---|---|---|
| a) Clamped vane | 175 | 19 |
| b) Clamped beam | 400 | 6 |
| c) Vane foam | 160 | 21 |
| d) Beam foam | 160 | 27 |

Figure 4A:
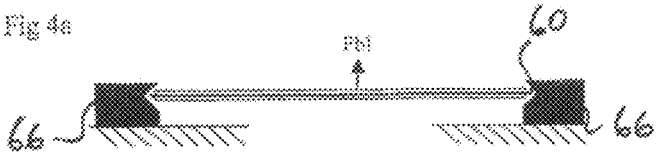
FIGS. 4*a* to 4*c* show three alternative electrically conductive mounting conditions.
Figure 4B:
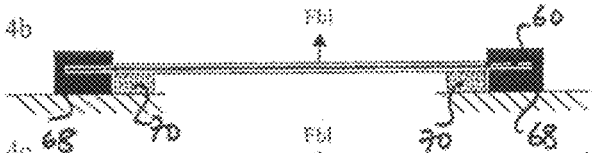
Figure 4C:
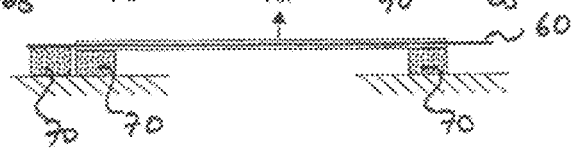

FIGS. 4*a* to 4*c* show four different electrically conductive couplers which may be used to couple the piezoelectric transducer to the housing of FIG. 1. In each Figure, the transducer comprises two piezoelectric beams and a central vane 60 which is sandwiched between and extends beyond the length of the two beams. In FIG. 4*a*, the central vane 60 is pivotally coupled to rigid foamed plastics blocks 66 made from Acrylonitrile Butadiene Styrene(ABS). In FIG. 4*b*, the central vane 60 extends into and is clamped to rigid foamed plastics blocks 68 made from Acrylonitrile Butadiene Styrene(ABS). Poron foamed plastics blocks 70 are also coupled to the ends of the lower piezoelectric beam. In FIG. 4*c*, the central vane 60 is coupled at both ends to poron foamed plastics blocks 70 and the lower beam at one end to a similar block. In each embodiment, the electrical connections, e.g. simple wires, are soldered to the blocks. However, it is expected that conducting foam blocks would also be suitable to make the connection between the ceramic beams and the central vane.

Figure 4D:
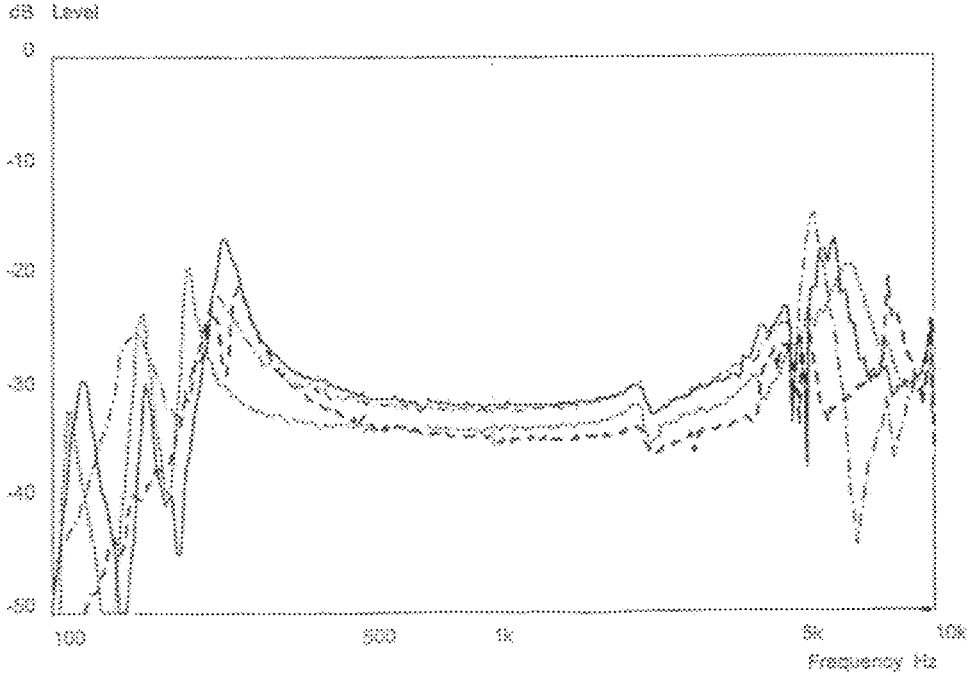
FIG. 4*d* is a graph of force against frequency for the mounting conditions of FIGS. 4*a* to 4*c*.

The table below shows the fundamental frequency $f_0$ and blocked force Fb1 taken from the offset central location. The embodiment of FIG. 4*c* which has two pairs of Poron foam blocks offers both the greatest force and lowest fundamental frequency. It is assumed that an increase in force will translate to an increase of power transferred and an increase in sound pressure level. The performances are also compared in FIG. 4*d*, in which the solid line shows the embodiment of FIG. 3*d*, the dashed line shows that of FIG. 4*a*, the dotted line that of FIG. 4*b* and chain dashed line that of FIG. 4*c*. The mounting condition of FIG. 4*c* is the most desirable.

| | fo (Hz) | $F_{bl}$ ($mN \cdot V^{-1}$) |
|---|---|---|
| 4a) Vane pivot | 160 | 21 |
| 4b) Clamped vane + foam | 230 | 19 |
| 4c) Foam on vane & beam | 160 | 27 |

Figure 5:
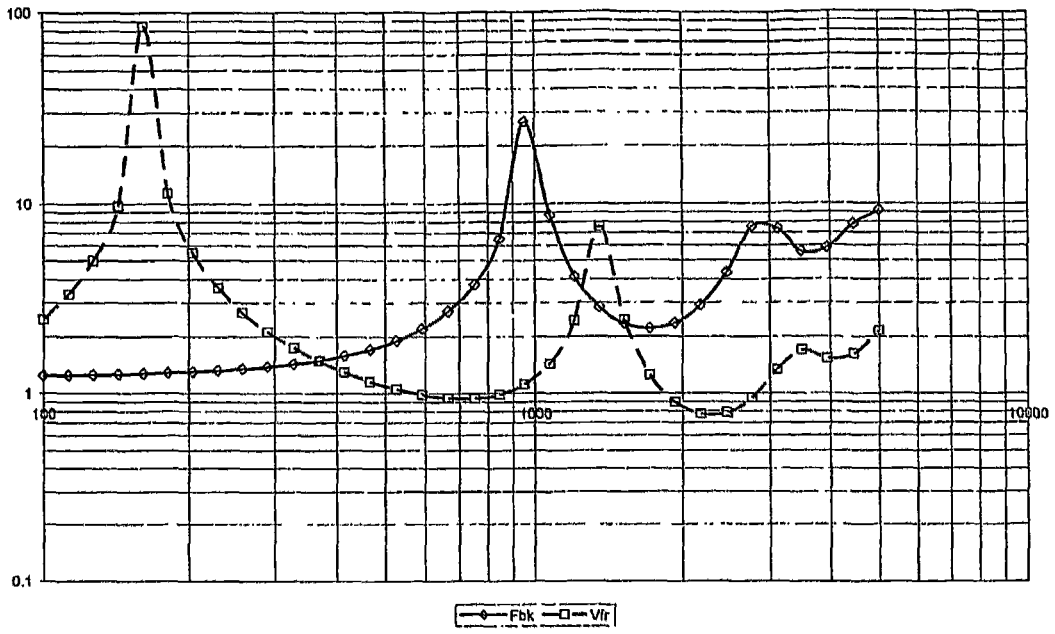
FIG. 5 is a graph showing force against frequency for a transducer supported according to the invention and a transducer with free mounting conditions.

FIG. 5 compares the performance of a distributed mode transducer which is free at both ends (Vfr) with that of a similar transducer which is mounted on Poron blocks (Fbk) at both ends. The use of Poron blocks approximates to a simply supported mounting condition. As shown a transducer with this mounting condition has an extra velocity mode at low frequency.

The invention claimed is:

1. Audio apparatus comprising:

a housing;

a piezoelectric transducer mounted in the housing so that the transducer is adjacent a user's pinna whereby the transducer excites vibration in the pinna to cause it to transmit an acoustic signal from the transducer to a user's inner ear and;

a coupler coupling the transducer to the housing with the coupler approximating to a simple support for the transducer, wherein the coupler is electrically conductive and is made from an elastomer.

2. Audio apparatus according to claim 1, wherein the transducer is a distributed mode transducer.

3. Audio apparatus according to claim 1 or claim 2, wherein the transducer is rectangular and the coupler comprises two blocks one mounted adjacent opposed edges of the transducer.

4. Audio apparatus according to claim 3, wherein the blocks are made from polymer or cellular foam.

5. Audio apparatus according to claim 1, wherein the housing comprises a resilient layer which forms the interface between the transducer and a user's pinna.

6. Audio apparatus according to claim 5, wherein the mechanical properties of the resilient layer and transducer are matched to optimise the contact force between the transducer and the pinna.

7. Audio apparatus according to claim 5 or claim 6, wherein the mechanical properties of the resilient layer and transducer are matched to optimise the frequency range of the transducer.

8. Audio apparatus according to claim 1, wherein the transducer comprises a central vane which is sandwiched between two piezoelectric elements and which extends beyond the ends of the piezoelectric elements and the conductive coupler is coupled to portions of the central vane which extend beyond the piezoelectric elements.

9. Audio apparatus according to claim 1, wherein the housing is attachable to eyewear.

10. Audio apparatus comprising: a housing; and a piezoelectric transducer mounted in the housing so that the transducer is adjacent a user's pinna whereby the transducer excites vibration in the pinna to cause it to transmit an acoustic signal from the transducer to a user's inner ear; and an electrically conductive coupler made from an elastomer coupling the transducer to the housing.

11. Audio apparatus according to claim 10, wherein the coupler approximates to a simple support for the transducer.

12. Eyewear incorporating audio apparatus according to claim 1 or claim 10.

* * * * *